United States Patent [19]

Johnston

[11] Patent Number: 4,878,580

[45] Date of Patent: Nov. 7, 1989

[54] SCENE AND VERSE COORDINATED MEDALLION AND CARD PACKAGED TOGETHER IN A TWO POCKETED TRANSPARENT PROTECTIVE PACKAGE

[76] Inventor: C. Lamar Johnston, 3641 Stratford, Dallas, Tex. 75205

[21] Appl. No.: 238,770

[22] Filed: Aug. 31, 1988

[51] Int. Cl.[4] ..... B65D 77/00

[52] U.S. Cl. ..... 206/216; 206/45.31; 206/232; 206/459; 383/38

[58] Field of Search ..... 206/0.81, 19, 45.31, 206/45.33, 216, 232, 459, 461, 471; 383/9, 38, 40

[56] References Cited

U.S. PATENT DOCUMENTS

| | | | |
|---|---|---|---|
| 2,292,924 | 8/1942 | Bourke | 206/459 |
| 2,861,404 | 11/1958 | Stratton, Jr. | 206/471 |
| 3,041,638 | 12/1961 | Farley | 206/459 |
| 3,211,503 | 12/1965 | Barnes | 206/461 |
| 3,288,280 | 11/1966 | Bostrom | 206/461 |
| 3,395,792 | 8/1968 | Larson | 206/459 |
| 3,844,409 | 10/1974 | Bodolay et al. | 383/9 |
| 4,020,694 | 3/1977 | Mayheu | 206/461 |
| 4,290,467 | 9/1981 | Schmidt | 383/9 |
| 4,712,673 | 12/1987 | Moore | 206/459 |
| 4,807,806 | 2/1989 | Neiman | 206/0.81 |

*Primary Examiner*—David T. Fidei
*Attorney, Agent, or Firm*—Warren H. Kintzinger

[57] ABSTRACT

Greetings along with a portrayal scene are duplicated on both a greetings card and a coin (medallion) packaged together in respective pockets of a two pocketed transparent package. Openings are provided in each pocket whereby the coin can be removed and the card, a folded over on itself card, may be removed for being signed personally and reinserted.

6 Claims, 1 Drawing Sheet

SCENE AND VERSE COORDINATED MEDALLION AND CARD PACKAGED TOGETHER IN A TWO POCKETED TRANSPARENT PROTECTIVE PACKAGE

BACKGROUND OF THE INVENTION

This invention relates in general to inspirational, valentines and general greeting cards and mementos, and more particularly, to scene and verse coordinated coins and cards packaged by matched pairs together in a two pocketed transparent protective material package.

Gifts such as greeting cards and mementos have assumed many shapes and forms and have been packaged in many ways. Many of these in the past have required large space consuming racks, trays, drawers and bins and when given as a gift still present storage problems for the recipient who while pleased with being given a large card or large memento faces the problem of storage. Another consideration is that of ease and convenience of shopping for cards and mementos where properly packaged and presented cards and mementos helps make selection and purchase both quicker and easier.

It is therefore a principla object of this invention to provide a common theme gift and coin pair in a common package.

Another object with such a gift product is to make selection and purchase quicker and more convenient.

A further object is to provide a common theme gift card and coin packaged together that requires minimal space in the store with displays and storage easy to use and stock.

Still another object is to provide such a gift product that has great appeal to the buying public with the throughtful conveyance bringing happiness to the receiver.

SUMMARY OF THE INVENTION

Features of the invention useful in accomplishing the above objects include, in a scene and verse coordinated common theme gift card and coin packaged together in a two pocketed transparent protective plastic package, are cards and coins whereby matched pairs, greetings along with a portrayal scene are duplicated on both the greeting card and the coin of a pair and with the pair packaged together in respective pockets of a two pocketed transparent plastic package. Top openings are provided in each pocket whereby the coin can be removed and the card, a folded over on itself card, may be removed for being personally signed and reinserted. Each of the paired card and coin packages is provided with a top tab with an opening for convenience mounting on arms of a display rack.

A specific embodiment representing what is presently regraded as the best mode of carrying out the invention is illustrated in the accompanying drawing.

DESCRIPTION OF THE PREFERRED EMBODIMENT

Figure 1:
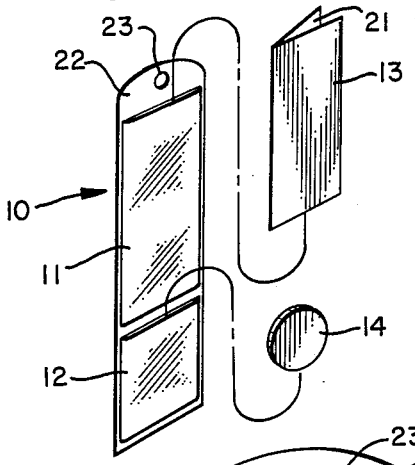
FIG. 1 represents a perspective view of the transparent package with two pockets with both the common theme card and coin carried thereby removed from their carrying pockets.
Figure 2:
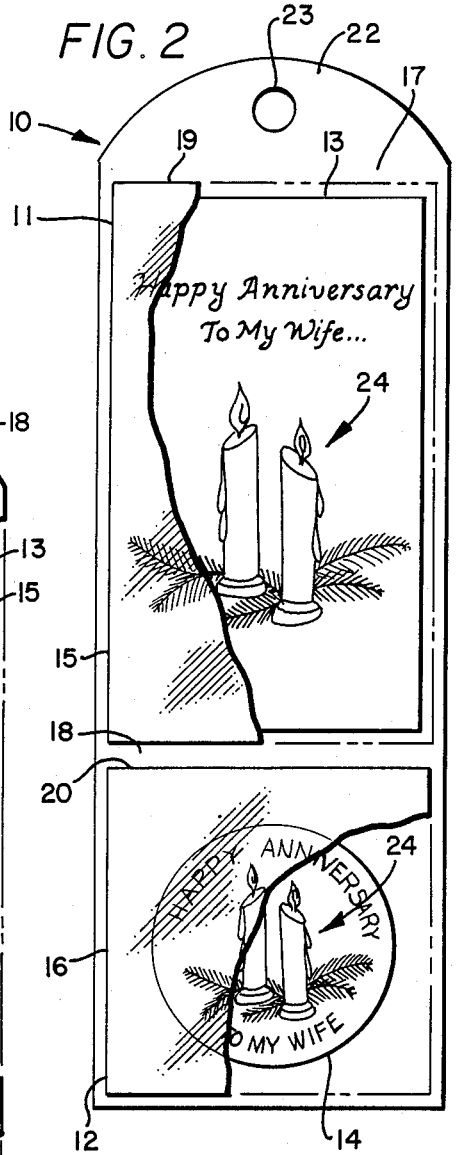
FIG. 2, a first side elevation view of the two pocket transparent package with part of each overlying pocket cut away for detail purposes and showing a common scene on the card and the coin; and, FIG. 3, a reverse side elevation view of the package again with part of the pockets cut away and illustrating that both the card and coin have a common theme saying printed thereon.
Figure 3:
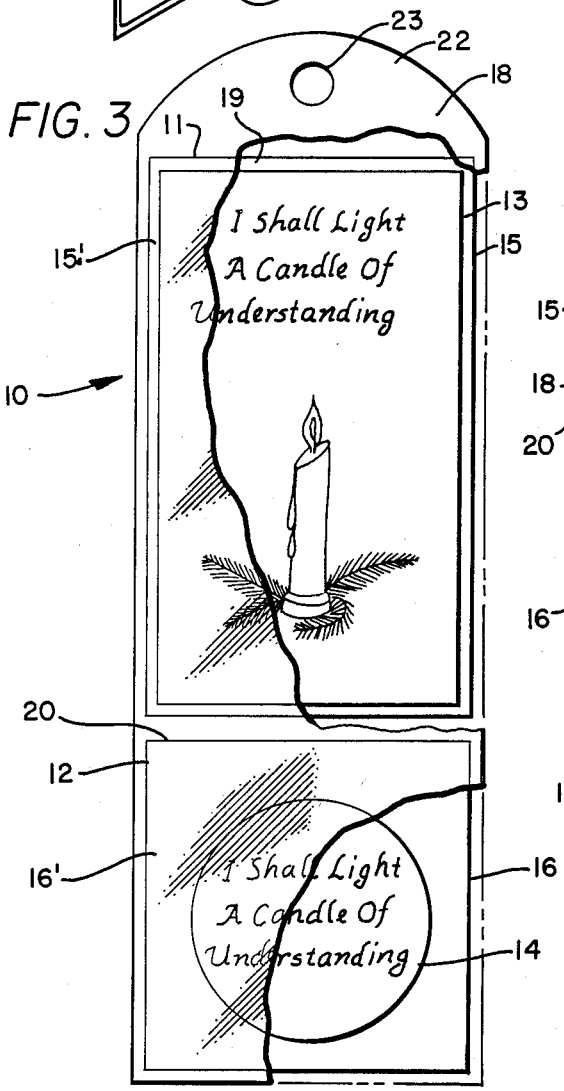

The two pocketed transparent protective plastic package 10 of FIGS. 1, 2 and 3 is shown to have a rectangular elongate larger pocket 11 at the top and immediately therebelow is square pocket 12 in planar projection with these individually sized and shaped to contain, respectively, a folded over on itself card 13 and a coin 14 (medallion). The pockets 11 and 12 are formed with, respectively, a rectangular sheet of transparent plastic 15 and a square sheet of transparent plastic 16 each heat seal bonded 15' and 16' to the front face 17 of the back 18 of plastic package 10, around three of the edges of each plastic sheet 15 and 16 leaving unsealed openings 19 and 20, respectively, of each for eas of removal of the card 13 for personal signature and a note on the inside 21 thereof and reinsertion in the card pocket 11, and removal from and replacement of the coin 14 in its pocket 12. The back 18 of each plastic package 10 includes a top tab extension 22, above the top opening 19 of pocket 11, provided with an opening 23 for convenience mounting thereof on arms of a compact easy to use rotatable display rack (detail not shown). The scene and verse coordinated coin 14 and card 13 packaged by matched pairs are compact and flat lending themselves also to easy stocking and display for selection from boxes and display shelves.

The forward face of the scene and verse coordinated coin 14 (or medallion) and card 13 packaged together in a two pocketed 11 and 12 transparent plastic protective package 10, as shown in FIG. 2, show the same artistic scene 24 of two burning candles with fern branches as an illustration of common artistic scene between the card 13 and the coin 14 of a coordinated pair in the package 10. On the back side of the card 13 and the coin 14 as shown in FIG. 3 both the card and the coin are shown to have the same verse "I Shall Light A Candle Of Understanding". While shown in this abbreviated form in FIG. 3, on an actual card and coin the verse reads "I Shall Light A Candle Of Understanding In Thine Heart Which Shall Not Be Put Out". In a matched pair card and coin with the valentine motif on the front side the card and the coin had a matching cupid overlapping a heart and on the other side of each a verse "You are the blossom and My rose . . . Please be My Valentine, The one Whome the Angles Chose".

Whereas this invention has been described with respect to several embodiments thereof, it should be realized that various changes may be made without depending from the essential contributions to the art made by the teachings hereof.

I claim:

1. A card and coin scene and verse coordinated together as a pair comprising: a card having a scene on a first side and a verse on the second side; a coin having a scene on a first side like te scene on a first side on the card, and a verse on a second side like the verse on the second side on the card, for marketing of the card and coin as a coordinated card and coin pair in the market place; wherein said card is a folded over on itself card for personal signature and note inscription on the inside of the card; said card and coin are packaged together in a protective package; said protective package is a transparent protective plastic package; said transparent protective plastic package includes two pockets a card containing pocket and a coin containing pocket; said card containing pocket is a rectangular pocket; and said conin containing pocket is a square pocket; said card pocket and said coin pocket are positioned in said package with the card pocket above the coin pocket in the common plane of said package; said card pocket and said coin pocket are of substantially the same width, and vertically aligned pockets; and wherein said card pocket is larger than said coin pocket.

2. The card and the coin scene and verse coordinated together of claim 1, wherein said card containing pocekt has an opening at the top to facilitate removal of the card for personal signature on the inside of the card and reinsertion of the card in the card pocket.

3. The card and the coin scene and verse coordinated together of claim 2, wherein said coin containing pocket has an opening at the top to facilitate removal from and replacement of the coin in the pocket.

4. The card and the coin scene and verse coordinated together of claim 3, wherein said card pocket and said coin pocket have a flexible interconnect where the package may be partially pulled up from a containing box and the card portion tilted back over like card and coin packages in the same storage box for convenience in viewing.

5. The card and the coin scene and verse coordinated together of claim 3, wherein said package is provided with a top tab extension above said card pocket; and a hole included in said top tab extension for convenience mounting thereof on mounting arms of display racks.

6. The card and the coin scene and verse coordinated together of claim 3, wherein said pockets are formed with two patches each of plastic each heat sealed on two opposite sides and across the bottom to a package back member.

* * * * *